US007800551B2

(12) United States Patent
McCown

(10) Patent No.: US 7,800,551 B2
(45) Date of Patent: Sep. 21, 2010

(54) PASSIVE PARABOLIC ANTENNA, WIRELESS COMMUNICATION SYSTEM AND METHOD OF BOOSTING SIGNAL STRENGTH OF A SUBSCRIBER MODULE ANTENNA

(76) Inventor: James Charles McCown, 2000 Sunset Rd., Lake Point, UT (US) 84074

( * ) Notice: Subject to any disclaimer, the term of this patent is extended or adjusted under 35 U.S.C. 154(b) by 887 days.

(21) Appl. No.: 11/656,687

(22) Filed: Jan. 23, 2007

(65) Prior Publication Data

US 2007/0296642 A1 Dec. 27, 2007

Related U.S. Application Data

(60) Provisional application No. 60/816,700, filed on Jun. 27, 2006.

(51) Int. Cl.
*H01Q 19/18* (2006.01)

(52) U.S. Cl. ..... 343/837; 343/840; 343/872

(58) Field of Classification Search ..... 343/702, 343/840, 781 R, 781 CA, 818, 834–837, 343/872

See application file for complete search history.

(56) References Cited

U.S. PATENT DOCUMENTS 3,859,657 A * 1/1975 Sterner ..... 342/28
6,133,882 A 10/2000 LaFleur et al.
6,445,360 B2 9/2002 Al-Rawi et al.
6,876,337 B2 4/2005 Larry
6,891,506 B2 5/2005 Jarmuszewski et al.
6,977,624 B1 * 12/2005 Szente et al. ..... 343/834
2002/0097185 A1 7/2002 Hershey et al.
2004/0201534 A1 10/2004 Hagiwara
2005/0017906 A1 1/2005 Man et al.

FOREIGN PATENT DOCUMENTS

EP 1 033 779 A2 9/2000
WO WO 00/74254 A1 12/2000

* cited by examiner

*Primary Examiner*—Michael C Wimer
(74) *Attorney, Agent, or Firm*—Morriss O'Bryant Compagni

(57) ABSTRACT

The invention is a passive parabolic antenna system for use with conventional subscriber module radio antennas. The passive parabolic antenna system includes a microwave feed assembly that forms a resonant cavity coupling device for coupling to an internal patch antenna of a conventional subscriber module radio antenna. A method of boosting signal strength of a conventional subscriber module radio antenna and a wireless communication system are also disclosed.

25 Claims, 9 Drawing Sheets

PASSIVE PARABOLIC ANTENNA, WIRELESS COMMUNICATION SYSTEM AND METHOD OF BOOSTING SIGNAL STRENGTH OF A SUBSCRIBER MODULE ANTENNA

CROSS-REFERENCE TO RELATED APPLICATIONS

This nonprovisional patent application claims benefit and priority under 35 U.S.C. §119(e) of the filing of U.S. Provisional Patent Application Ser. No. 60/816,700 filed on Jun. 27, 2006, titled "PASSIVE PARABOLIC ANTENNA SYSTEM AND METHOD FOR BOOSTING SIGNAL STRENGTH OF A SUBSCRIBER MODULE ANTENNA", the contents of which are incorporated herein by reference for all purposes. This nonprovisional patent application is also related to U.S. Design patent application Ser. No. 29/264,719 filed on Aug. 16, 2006, titled: "PARABOLIC ANTENNA", the contents of which are also incorporated herein by reference for all purposes.

BACKGROUND OF THE INVENTION

1. Field of the Invention

The present invention relates generally to antennas for wireless communication systems. More particularly, this invention relates to a passive parabolic antenna system and method for boosting signal strength of subscriber module radio antennas.

2. Description of Related Art

Conventional wireless broadband radio systems are becoming increasingly popular for providing data and voice communications that are free from electrical connections. Popular home and office based wireless systems may be based on various wireless network communication standards. Examples of such wireless standards may include those promulgated by the Institute for Electrical and Electronics Engineers (IEEE), particularly IEEE 802.11 based standards.

More sophisticated business-based wireless communications systems suitable for building to building transmissions may operate at various frequency bands including 2.4 GHz, 900 MHz, 5.2 GHz and 5.7 GHz with various transmission protocols. For example, the Unlicensed National Information Infrastructure radio band (UNII) is part of the radio frequency spectrum used by IEEE-802.11a wireless devices. UNII operates over various frequency ranges from about 5.2 GHz to about 5.8 GHz. Some of these more sophisticated wireless communications systems achieve greater operational distances by utilizing higher broadcasting power. However, increasing power may cause interference to other communications systems and increases cost.

One particular wireless transmission system is the Motorola™ Canopy® subscriber module, available from Motorola Canopy, 1299 East Algonquin Rd., Schaumburg, Ill. 60196. The Motorola™ Canopy® subscriber module radio antenna 200 (see FIGS. 11A-B) is used to transmit from building to building or over distances of 1-2 miles at frequencies ranging from 5.745 to 5.805 GHz. However, there is always a need for improved signal strength and greater distances between antennas.

Accordingly, there exists a need in the art for a passive parabolic antenna system and method capable of passively coupling to conventional subscriber module radio antennas operating at any suitable frequency and power to improve signal strength and thereby increasing the operational distance between antennas without resorting to increasing power to generate transmission signals.

BRIEF SUMMARY OF THE INVENTION

The invention is a passive parabolic antenna that incorporates a parabolic reflector with a passive coupling and feed mechanism for use with conventional subscriber module radio antennas. The passive parabolic antenna forms a resonant cavity coupling device that couples to the existing internal patch antenna of a conventional subscriber module radio antenna. A method of boosting signal strength of a conventional subscriber module radio antenna and a wireless communication system are also disclosed.

Additional features and advantages of the invention will be apparent from the detailed description which follows, taken in conjunction with the accompanying drawings, which together illustrate, by way of example, features of embodiments of the present invention.

BRIEF DESCRIPTION OF THE SEVERAL VIEWS OF THE DRAWINGS

The following drawings illustrate exemplary embodiments for carrying out the invention. Like reference numerals refer to like parts in different views or embodiments of the present invention in the drawings.

DETAILED DESCRIPTION OF THE INVENTION

The invention is a passive parabolic antenna for use with conventional subscriber module radio antennas. The passive parabolic antenna forms a resonant cavity coupling device that couples to the existing internal patch antenna of a conventional subscriber module radio antenna. A method of boosting signal strength of a conventional subscriber module radio antenna using the passive parabolic antenna and a wireless communication system including same is also disclosed.

Figure 1:
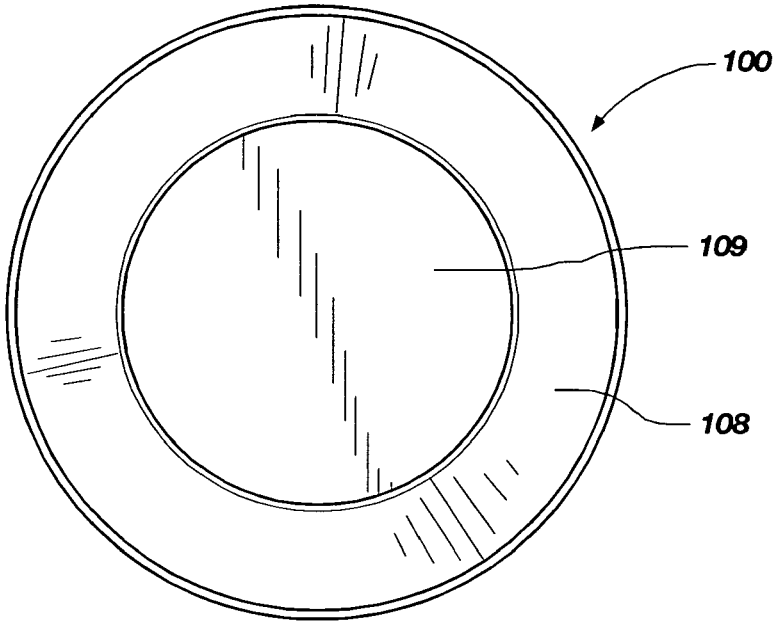
FIG. 1 is a front view of a parabolic antenna according to the present invention.
Figure 2:
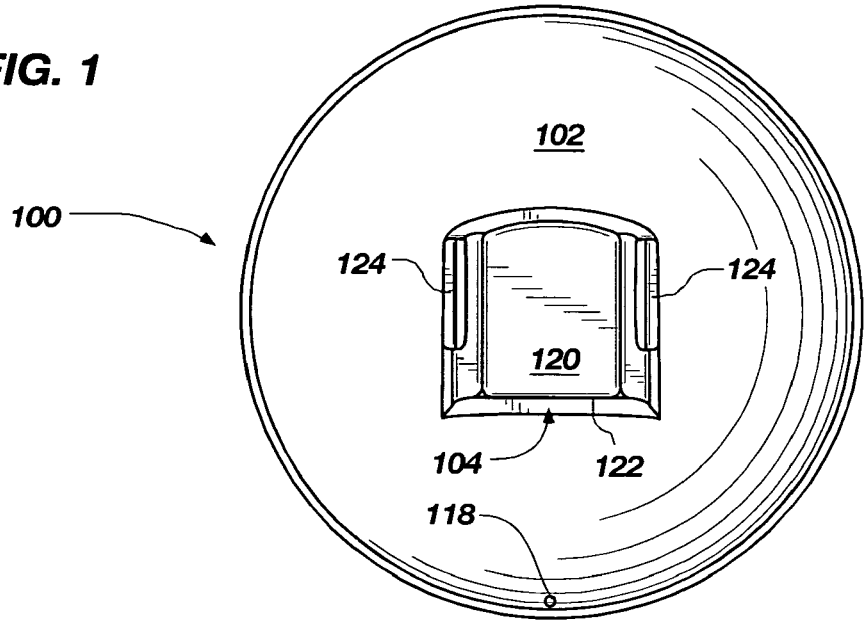
FIG. 2 is a back view of a parabolic antenna according to the present invention.
Figure 3:
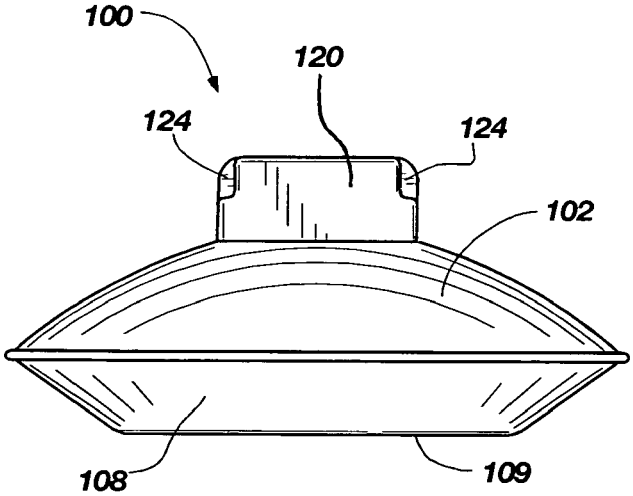
FIG. 3 is a top view of a parabolic antenna according to the present invention.

FIGS. 1-3 illustrate front, back and top views, respectively of an embodiment of an assembled passive parabolic antenna 100 according to the present invention. The passive parabolic antenna 100 may include a parabolic reflector 102 mated with an antenna cover 108. The antenna cover may include a covering 120 for a subscriber module pocket 104 at the bottom end 122 of the covering 120. Antenna cover 108 may be generally dish-shaped with a flat portion 109. According to another embodiment, the passive parabolic antenna 100 may include a metallic subreflector 126 on an inside surface (see FIG. 10B) of the flat portion 109 of the antenna cover 108. The purpose and further description of the metallic subreflector 126 is further elaborated below.

As shown particularly in FIG. 2, the passive parabolic antenna 100 may have small drain holes 118 (one illustrated) for draining water that may collect within the passive parabolic antenna 100 during inclement weather, according to one embodiment. FIGS. 2-3 also illustrate indentations 124 in covering 120 that may be ramped within the subscriber module pocket 104 to effect an interference or friction fit with a given subscriber module radio antenna (not shown but see 200 in FIGS. 11A-B).

Figure 4:
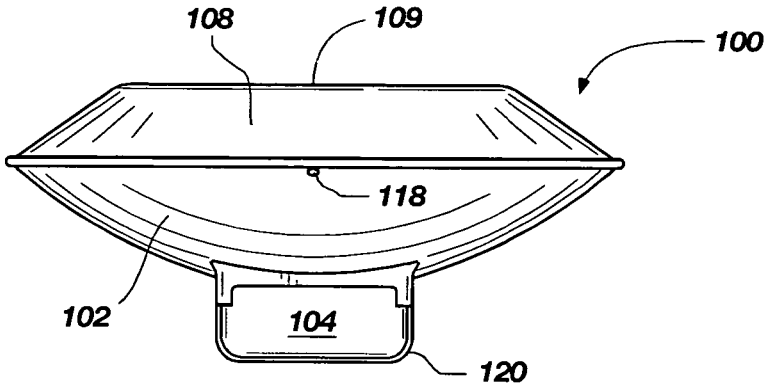
FIG. 4 is a bottom view of a parabolic antenna according to the present invention.
Figure 5:
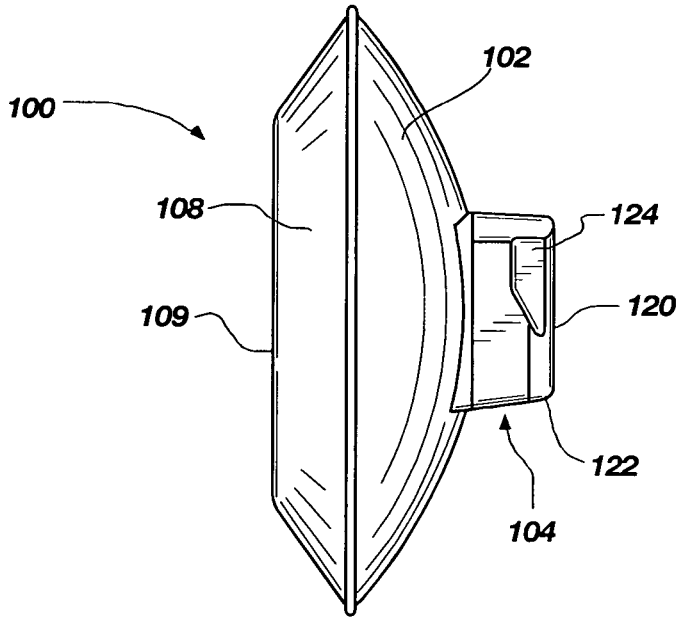
FIG. 5 is a right side view of a parabolic antenna according to the present invention.
Figure 6:
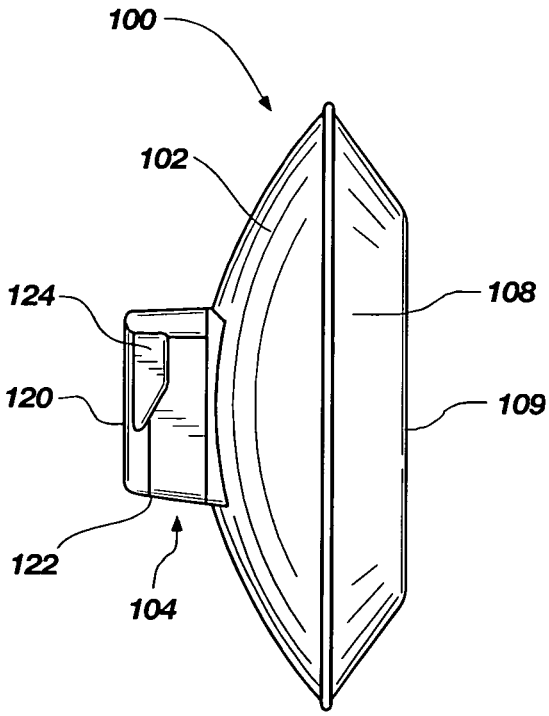
FIG. 6 is a left side view of a parabolic antenna according to the present invention.
Figure 11A:
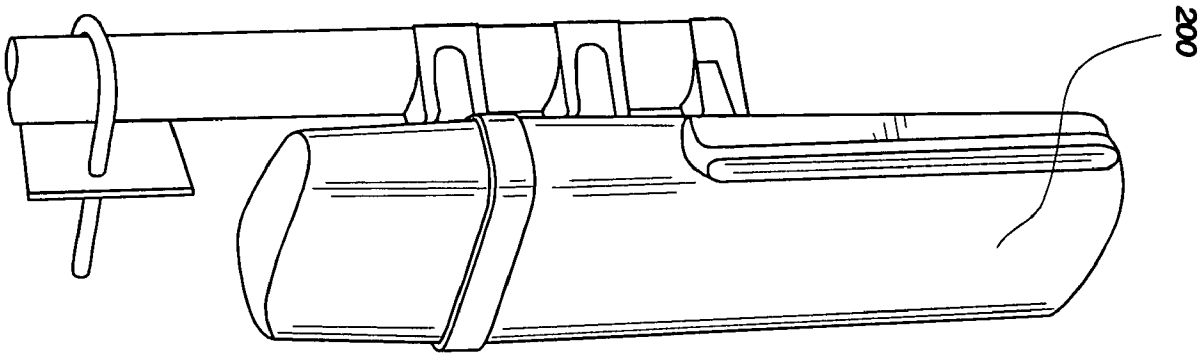
FIG. 11A (PRIOR ART)
FIGS. 11A-B are perspective images of a conventional subscriber module radio antenna.
Figure 11B:
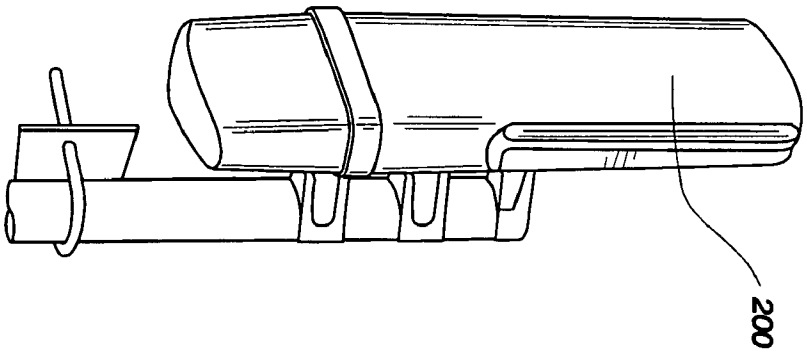
FIG. 11B (PRIOR ART)

Referring now to FIGS. 4-6, bottom, right side and left side views, respectively, of the embodiment of a passive parabolic antenna 100 are shown. In particular, FIG. 4 illustrates the subscriber module pocket 104 and an exemplary small drain hole 1 18. The subscriber module pocket 104 may be configured to receive any suitable subscriber module radio antenna consistent with the teachings of the present invention. For example and not by way of limitation, the subscriber module pocket 104 may be configured to receive a conventional Motorola™ Canopy® subscriber module radio antenna (see 200 as illustrated in FIGS. 11A-B and as further discussed herein). FIGS. 5 and 6 also illustrate indentations 124 in covering 120 that may be ramped within the subscriber module pocket 104 to effect an interference or friction fit with a given subscriber module radio antenna, e.g., the Motorola™ Canopy® subscriber module radio antenna (see 200 as illustrated in FIGS. 11A-B).

Figure 7:
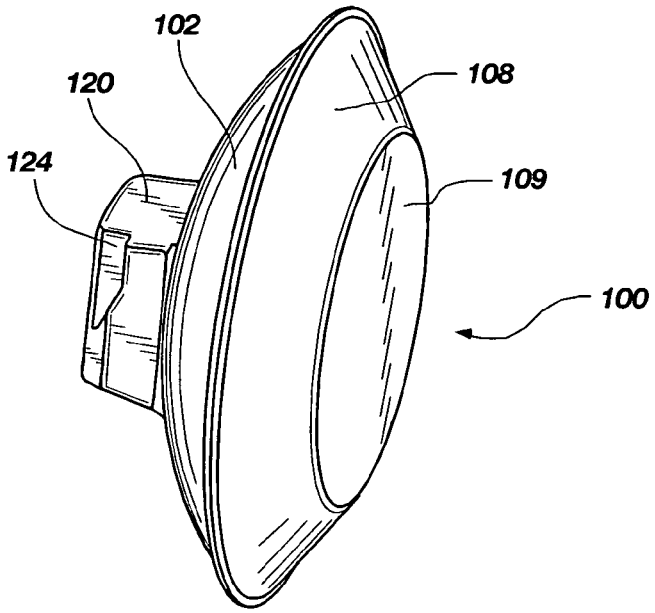
FIG. 7 is a left-front perspective view of a parabolic antenna according to the present invention.
Figure 8:
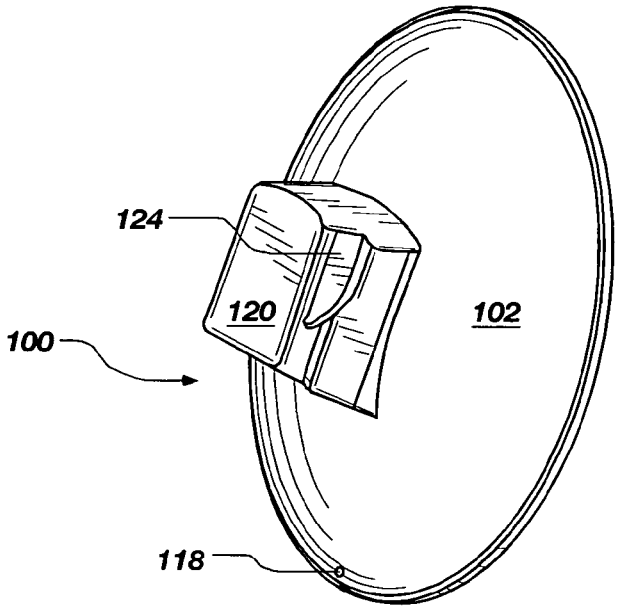
FIG. 8 is a left-rear perspective view of a parabolic antenna according to the present invention.
Figure 9:
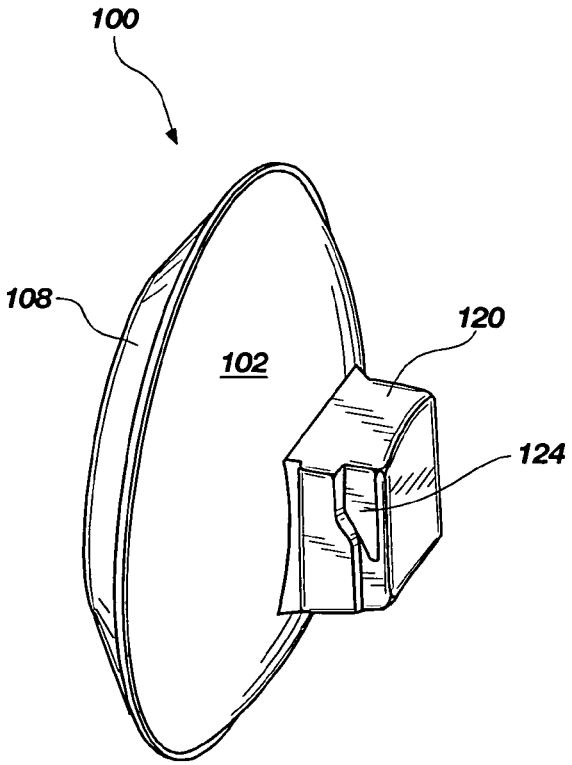
FIG. 9 is a right-rear perspective view of a parabolic antenna according to the present invention.

FIGS. 7-9 are additional left-front, left-rear and right-rear perspective views, respectively, of the embodiment of a passive parabolic antenna 100 shown in FIGS. 1-6. In particular, FIGS. 7-9 further illustrate indentations 124 in covering 120 that may be configured to effect an interference or friction fit with a given subscriber module radio antenna, e.g., the Motorola™ Canopy® subscriber module radio antenna (see 200 as illustrated in FIGS. 11A-B). It will be noted that other means of securing the passive parabolic antenna 100 to a given subscriber module radio antenna may also be used consistent with the present invention. Such other means may include, for example and not by way of limitation, adhesives, fasteners, screws, mechanical detents, locking mechanisms and any other suitable securing means known to those of ordinary skill in the art consistent with the teachings of the present invention.

Figure 10A:
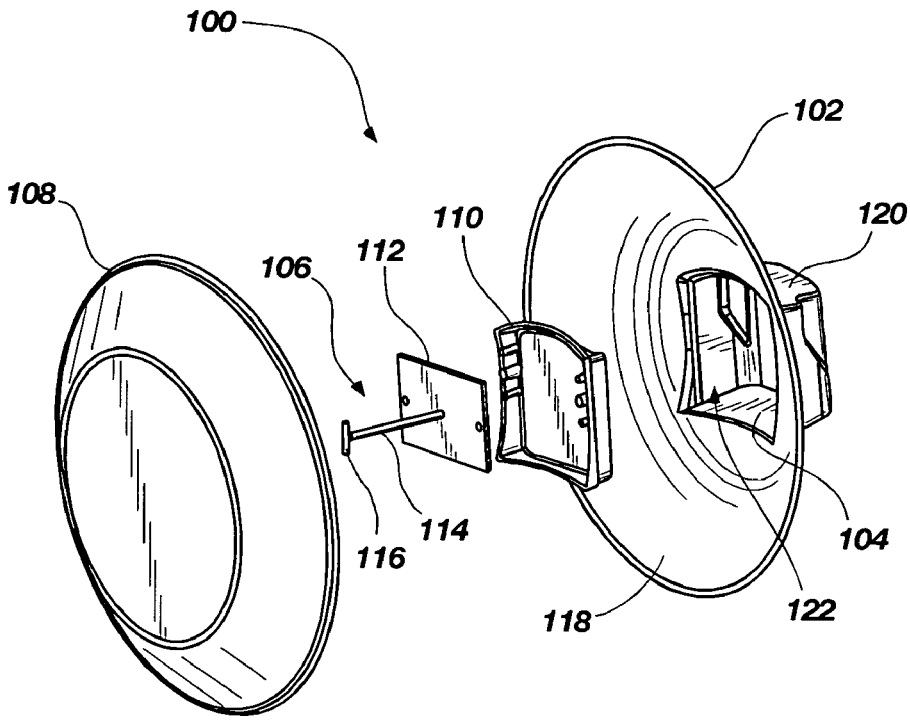
FIGS. 10A-B are exploded perspective views of components of a passive parabolic antenna according to an embodiment of the present invention.
Figure 10B:
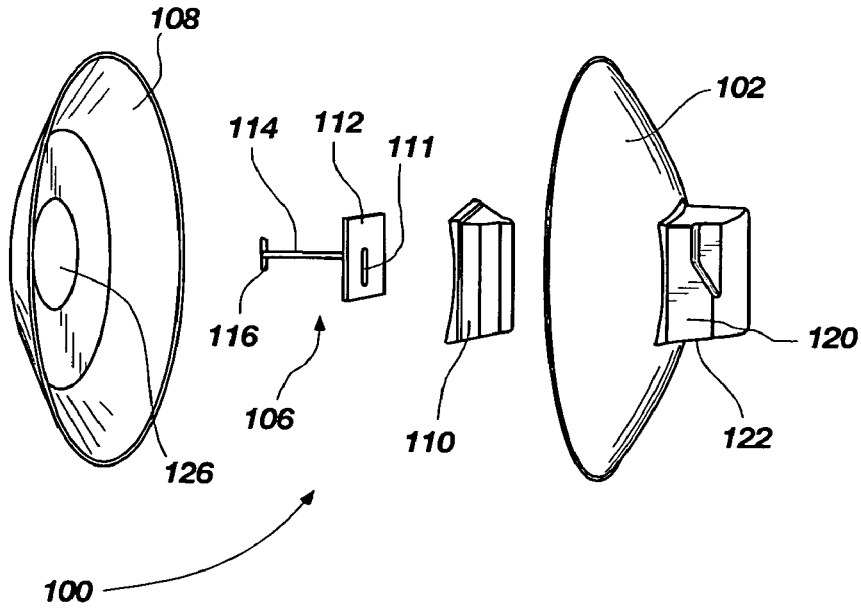

FIGS. 10A-B are exploded perspective views of components within an embodiment of a passive parabolic antenna 100 according to the present invention. Referring to FIGS. 10A and 10B, the passive parabolic antenna 100 may include a parabolic reflector 102 and a subscriber module pocket 104 approximately centered in the parabolic reflector 102. The subscriber module pocket 104 may include a covering 120 for surrounding the top of a conventional subscriber module antenna (see 200 in FIGS. 11A-B and related discussion below). The bottom end 122 of subscriber module pocket 104 is open to receive the top of a conventional subscriber module antenna, e.g., see 200 in FIGS. 11A-B and related discussion herein.

The passive parabolic antenna 100 may further include a microwave feed assembly 106 configured for placement adjacent the subscriber module pocket 104. The structure of the subscriber module pocket 104 and/or the parabolic reflector 102 may be configured to receive microwave feed assembly 106 directly. The microwave feed assembly 106 may be configured to mount to the subscriber module pocket 104 and/or the parabolic reflector 102 via screws, snaps, adhesive or any other suitable means for securing the microwave feed assembly 106 adjacent to the subscriber module pocket 104.

The passive parabolic antenna 100 may further include an antenna cover 108 configured to mate with the parabolic reflector 102 and enclose the microwave feed assembly 106. The antenna cover 108 may be configured to hold a small foil patch subreflector (not shown in FIGS. 10A-B). The antenna cover 108 may further be configured to provide shelter for the microwave feed assembly 106. The subreflector (not shown in FIGS. 10A-B) provides additional signal coupling to the dipole 116, see further discussion below. According to another embodiment, the passive parabolic antenna 100 may further include an insert panel 110 for receiving the microwave feed assembly 106 and interfacing with the subscriber module pocket 104. The insert panel may be secured to the parabolic reflector 102 by any suitable means, for example and not by way of limitation, adhesives, snaps, screws, detents or any other suitable securing means known to those skilled in the art.

The antenna cover 108 may be formed of any suitable dielectric materials, for example and not by way of limitation, acrylonitrile-butadiene-styrene (ABS) plastic, or any other plastic-like material, according to embodiments of the present invention. The antenna cover 108 is configured to be generally transparent to electromagnetic radiation.

The parabolic reflector 102 may also be formed of a plastic or plastic-like material according to embodiments of the passive parabolic antenna 100. According to a particular embodiment, the parabolic reflector 102 may further include a metallic (conductive) covering or lining on a surface, e.g., the inside surface, of the parabolic reflector 102. The metallic covering or lining is reflective of electromagnetic radiation. The metallic covering or lining may be formed by plasma arc coating of zinc or any other suitable means of providing a metallic coating on a surface of a parabolic reflector 102 comprising plastic structural material. According to another embodiment, the metallic lining may be formed of plasma arc coated metal, e.g., zinc. According to another embodiment, the metallic lining may be adhesively secured metal foil, e.g., aluminum foil. Alternatively, the parabolic reflector 102 may be formed of a metal or metal-like (conductive) material according to yet another embodiment of the present invention. It will be noted that any suitable metal may be used for the metallic lining or for the parabolic reflector 102 according to the teachings of the present invention.

According to certain embodiments, the passive parabolic antenna 100 may not be completely sealed or waterproof. Thus, water may collect inside the passive parabolic antenna 100 during wet environmental conditions. One embodiment of the passive parabolic antenna 100 may include one or more small drain holes 118 (see one small drain hole located at arrow 118 in FIGS. 2, 4, 8 and 10A). The drain holes 118 may be formed in the parabolic reflector 102 and/or the antenna cover 108 according to embodiments of the present invention. Small drain holes 118 formed in a lower region of the parabolic reflector 102 and/or the antenna cover 108 allow water to escape under the force of gravity, and/or water vapor to escape into the atmosphere.

According to one embodiment of the present invention, the microwave feed assembly 106 may include a small rectangular patch antenna 111 (see FIG. 10B) adjacent to a planar sheet of conductive material 112. The planar sheet of conductive material 112 may serve as a ground plane for the patch antenna 111. The generally planar sheet of conductive material 112 may be connected to a generally linear conductive rod 114, which is in turn connected to a dipole 116. The linear conductive rod 114 may be formed of a piece of semi-rigid coaxial cable according to one embodiment of microwave feed assembly 106. According to another embodiment, dipole 116 may be adjacent to or connected to a small foil patch subreflector 126 (FIG. 10B) on the inside surface of antenna cover 108. The foil patch subreflector 126 may serve as a ground plane for the microwave feed assembly 106 when fully assembled. The subreflector may be formed of plasma arc coated metal, e.g., zinc, or an adhesive foil patch, e.g., an aluminum foil patch glued to the inner surface of the flat portion 109 of the antenna cover 108.

The microwave feed assembly 106 forms a dipole antenna. The parabolic reflector 102 concentrates the field strength at the dipole 116. The passive parabolic antenna 100 gathers, concentrates and couples communication signals into the microwave feed assembly 106 in a passive manner that does not require any direct electrical connection with an external subscriber module antenna (see, e.g., 200 in FIGS. 11A-B and 12).

The passive parabolic antenna 100 of the present invention may be configured for use with any conventional subscriber module antenna. FIGS. 11A-B are perspective images of a conventional subscriber module radio antenna 200, specifically a Motorola™ Canopy® subscriber module, available from Motorola Canopy, 1299 East Algonquin Rd., Schaumburg, Ill. 60196. However, the passive parabolic antenna 100 of the present invention is not limited to Motorola™ Canopy® subscriber modules and may be configured for use with any other suitable subscriber module antenna. For example and not by way of limitation, an embodiment of the passive parabolic antenna 100 of the present invention may be configured to work with a subscriber module antenna in an Access5830™, 5.8/5.3 GHz Dual-Band Wireless Broadband System available from Trango Broadband Wireless, a division of Trango Systems, Inc., 15070 Avenue of Science, Suite 200, San Diego, Calif. 92128.

Referring generally to FIGS. 1-10B, specific embodiments of a passive parabolic antenna 100 are described below. According to one embodiment, the passive parabolic antenna 100 includes a parabolic reflector 102 and a subscriber module pocket 104 approximately centered in the parabolic reflector 102. The passive parabolic antenna 100 further includes a microwave feed assembly 106 configured for placement adjacent the subscriber module pocket 104, wherein the microwave feed assembly 106 is configured to mate with a subscriber module antenna (see 200 in FIGS. 11A-B and 12) by forming a resonant cavity. The passive parabolic antenna 100 further includes an antenna cover 108 configured to mate with the parabolic reflector 102 and enclose the microwave feed assembly 106.

According to another embodiment, the passive parabolic antenna 100 further includes an insert panel 110 for receiving the microwave feed assembly 106 and interfacing with the subscriber module pocket 104. According to another embodiment of the passive parabolic antenna system 100, the parabolic reflector 102 is formed of a plastic material having a metallic lining on an inner surface.

According to another embodiment of the passive parabolic antenna system 100, the microwave feed assembly 106 further includes a patch antenna 111 configured to form part of a resonant cavity. According to this embodiment of the passive parabolic antenna system 100, the microwave feed assembly 106 further includes a planar sheet of conductive material 112 connected to the patch antenna 111. According to this embodiment of the passive parabolic antenna system 100, the microwave feed assembly 106 further includes a linear conductive rod 114 connected at one end to the planar sheet of conductive material 112. According to this embodiment of the passive parabolic antenna system 100, the microwave feed assembly 106 further includes a dipole 116 connected to an opposite end of the linear conductive rod 114.

According to yet another embodiment of the passive parabolic antenna system 100, the subscriber module pocket 104 may be configured to receive a subscriber module radio antenna (see 200 in FIGS. 11A-B and 12). The fit between the subscriber module pocket 104 and subscriber module radio antenna 200 may be achieved through interference fit, secured by use of fasteners and even by use of a detent mechanism, according to various embodiments of the passive parabolic antenna system 100. However, one of ordinary skill in the art with readily appreciate that the present invention is not limited to these specific means for securing the subscriber module pocket 104 to the subscriber module radio antenna 200.

Figure 13:
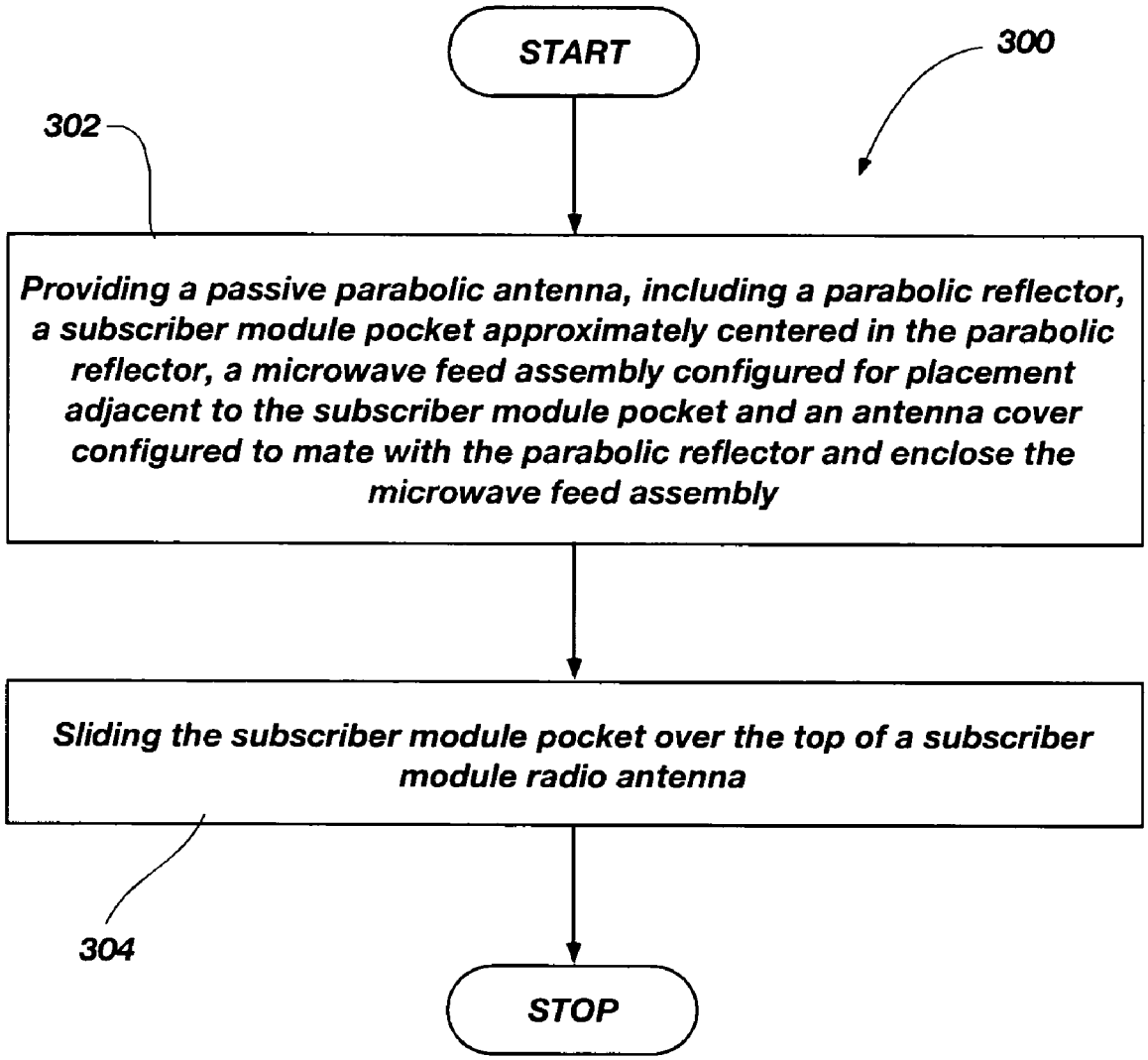
FIG. 13 is a flowchart of an embodiment of a method of boosting signal strength of a conventional subscriber module radio antenna, according to the present invention.

FIG. 13 is a flowchart of an embodiment of a method 300 of boosting signal strength of a conventional subscriber module radio antenna, according to the present invention. Method 300 may include providing 302 a passive parabolic antenna, e.g., passive parabolic antenna 100 as described above. The passive parabolic antenna may include a parabolic reflector 102, a subscriber module pocket 104 approximately centered in the parabolic reflector 102, a microwave feed assembly 106 configured for placement adjacent to the subscriber module pocket 104 and an antenna cover 108 configured to mate with the parabolic reflector 102 and enclose the microwave feed assembly 106. Method 300 may further include sliding 304 the subscriber module pocket over the top of a subscriber module radio antenna.

According to another embodiment of method 300, sliding 304 the subscriber module pocket 104 over the top of the subscriber module radio antenna 200 may achieve an interference fit between the subscriber module pocket 104 and the subscriber module radio antenna 200 (FIGS. 11A-B). According to still another embodiment, method 300 may further include applying an adhesive on the outside of the top of the subscriber module radio antenna or the inside of the subscriber module pocket or both prior to sliding the subscriber module pocket over the top of the subscriber module radio antenna 200.

According to yet another embodiment, method 300 may further include adjusting the aim of the passive parabolic antenna 100 toward a selected target to maximize signal gain. According to another embodiment, method 300 may further include providing an insert panel 110 for receiving the microwave feed assembly 106 and interfacing with the subscriber module pocket 104. According to still another embodiment, method 300 may further include the parabolic antenna formed of a plastic material having a metallic lining on an inner surface.

Figure 12A:
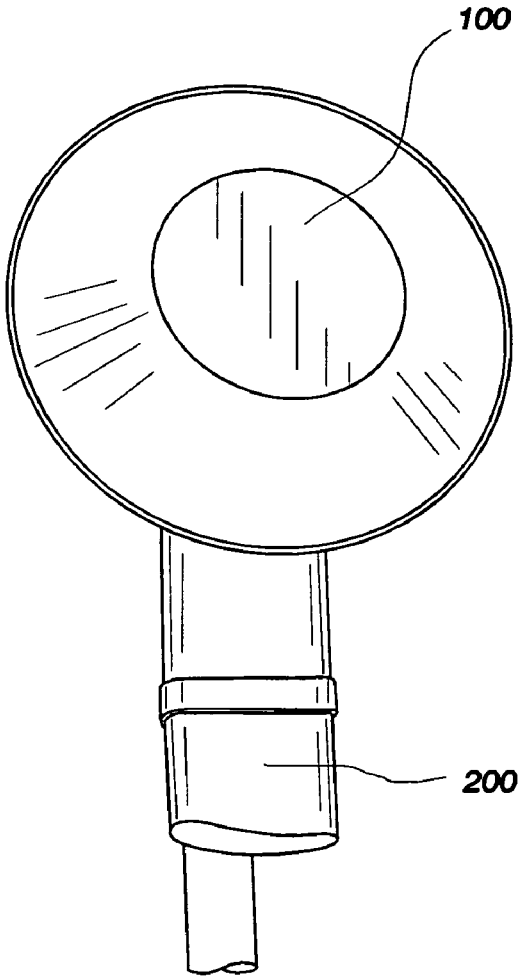
FIGS. 12A-B are perspective images of the embodiment of a passive parabolic antenna shown in FIGS. 10A-B as mounted on a conventional subscriber module radio antenna, such as those shown in FIGS. 11A-B.
Figure 12B:
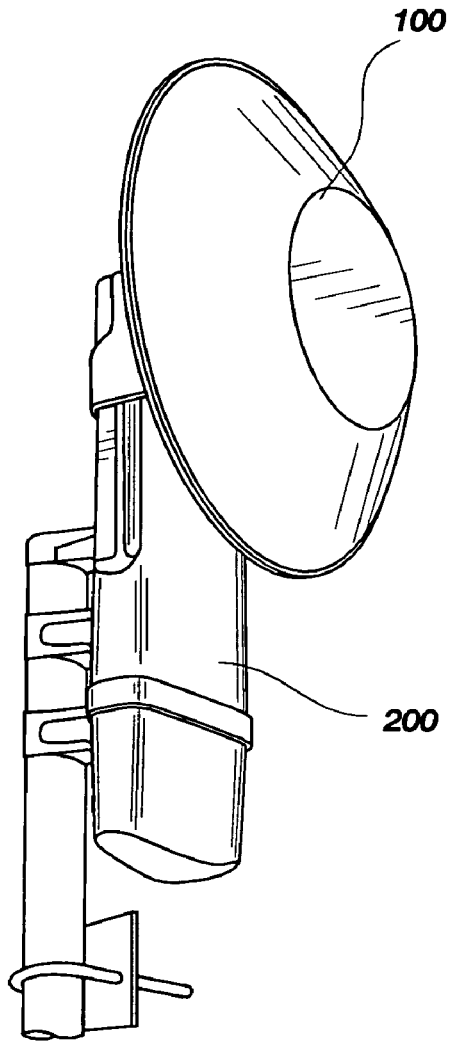

Once the passive parabolic antenna 100 has been placed over the conventional subscriber module radio antenna 200, it may appear as shown in FIGS. 12A-B. FIGS. 12A-B are perspective images of the embodiment of a passive parabolic antenna 100 (shown in FIGS. 1-10B) as mounted on a conventional subscriber module radio antenna 200 (shown in FIGS. 11A-B). Embodiments of the passive parabolic antenna 100 of the present invention may be used with any subscriber module antenna, at any suitable frequencies and powers of transmission.

Figure 14:
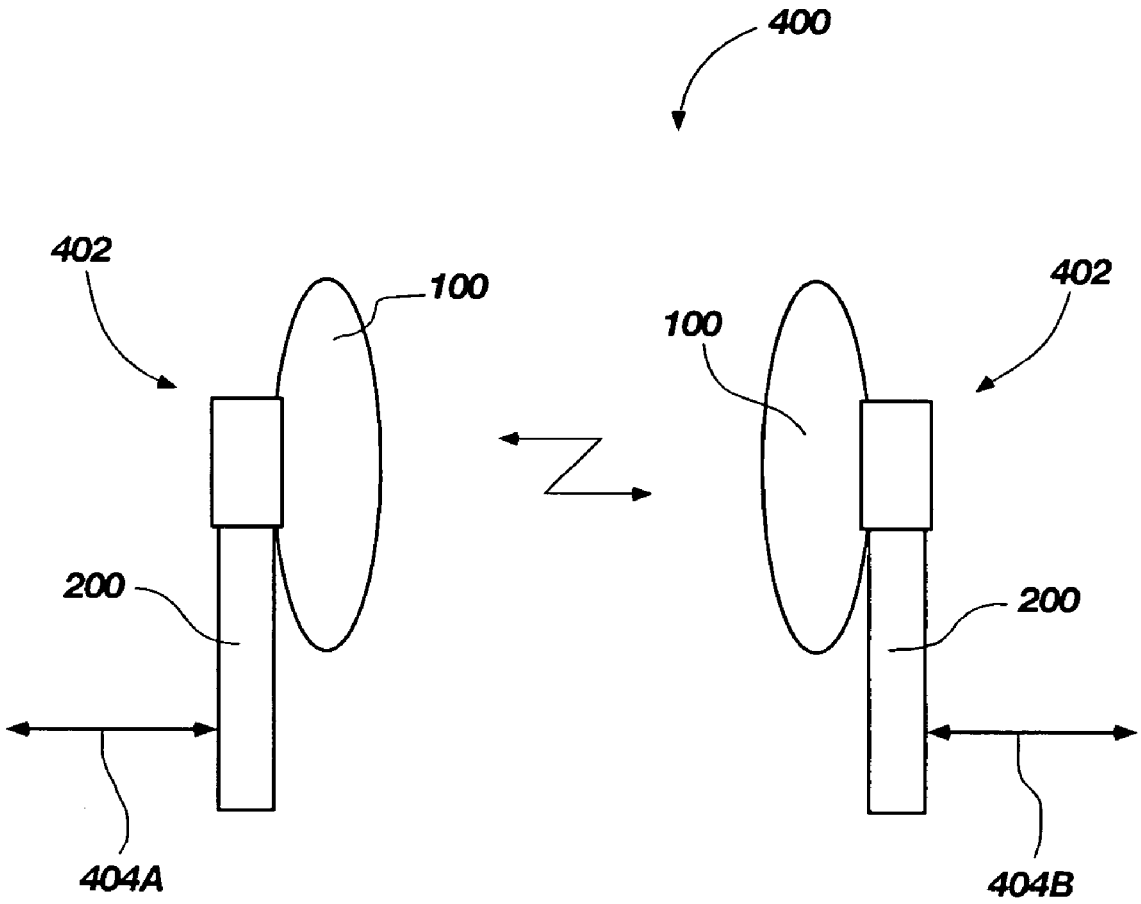
FIG. 14 is a block diagram of an embodiment of a wireless communications system, according to the present invention.

FIG. 14 is a block diagram of an embodiment of a wireless communication system 400, according to the present invention. System 400 may include a pair of wireless transceivers 402 directed at each other from a given distance. Each wireless transceiver 402 may include a subscriber module radio antenna 200 in communication with a passive parabolic antenna 100 as described herein. Each wireless transceiver 402 may further be configured for connection to a computer network 404A and 404B. The computer networks 404A-404B may include Ethernet cabling. Though not shown, each subscriber module radio antenna 200 may also require connection to a power supply (not shown). Because of the increased signal gain achieved by the use of the passive parabolic antennas 100, the given distance between the wireless transceivers 402 may be greater than if the subscriber module radio antennas 200 were used without the passive parabolic antennas 100.

The passive parabolic antenna 100 of the present invention forms a resonant cavity coupling device that couples to the existing internal patch antenna of a conventional subscriber module radio antenna 200 (FIGS. 11A-B). The combination of the passive parabolic antenna 100 of the present invention coupled to a conventional subscriber module radio antenna 200 (FIGS. 11A-B), provides passive signal gain through a low-loss connection between the internal patch antenna of the subscriber module 200 and the passive parabolic antenna 100.

Figure 15:
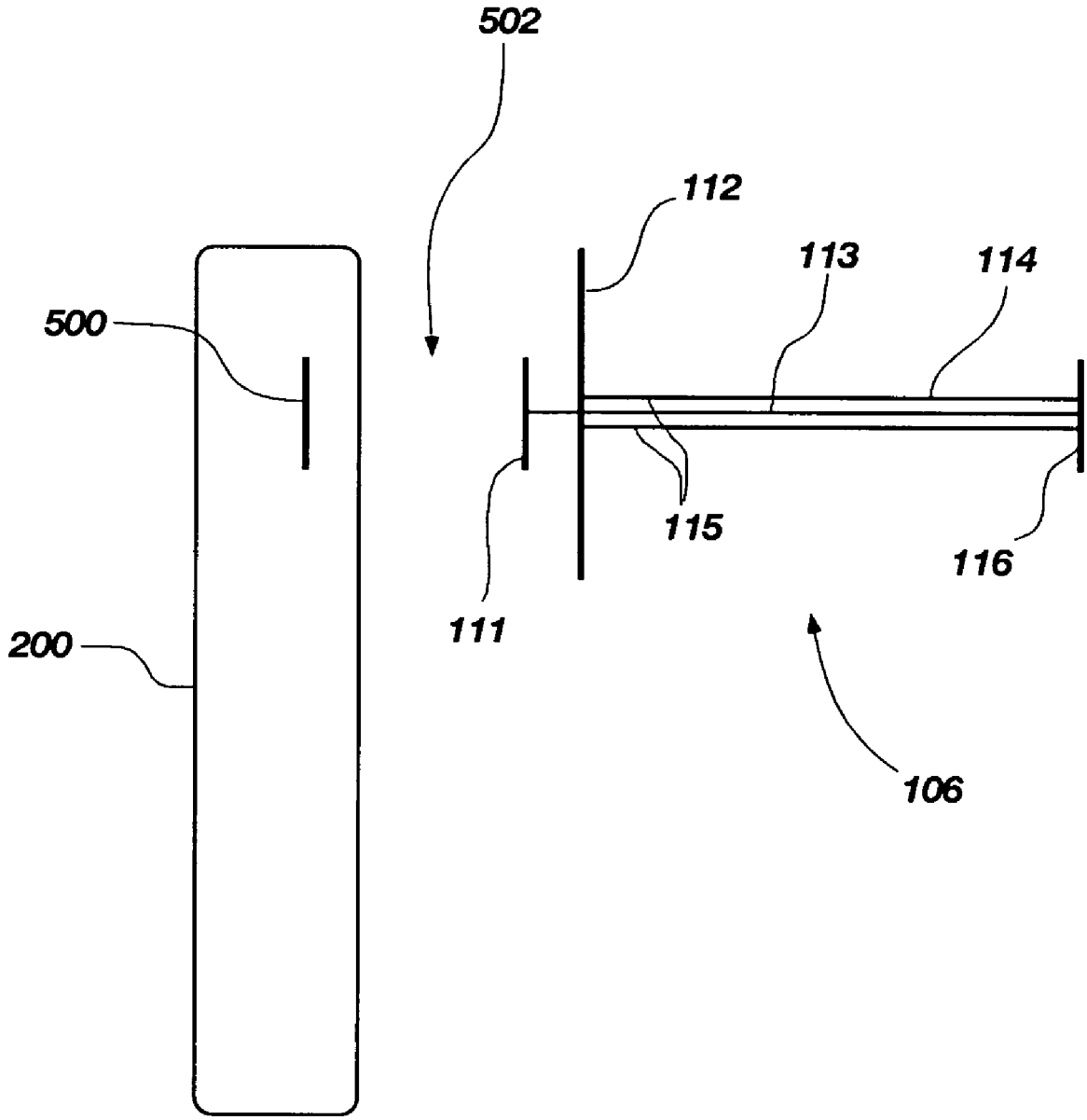
FIG. 15 is a diagram of resonant cavity coupling, according to the present invention.

Referring now to FIG. 15, a diagrammatic view of resonant cavity coupling is shown, according to the present invention. The resonant cavity, shown generally at arrow 502, may be found between a subscriber module patch antenna 500 within the subscriber module antenna 200 (FIGS. 11A-B) and the patch antenna 111 of the microwave feed assembly 106 of the passive parabolic antenna 100 (not completely shown in FIG. 15). According to the side view of the microwave feed assembly shown in FIG. 15, the patch antenna 111 is adjacent to the planar sheet of conductive material 112. The patch antenna 111 may be generally parallel to the planar sheet of conductive material 112. The planar sheet of conductive material may be formed of a copper-clad printed circuit board. The planar sheet of conductive material 112 may be electrically connected to the outer surface 115 of the linear conductive rod 114. An inner conductor 113 within the linear conductive rod 114 may be electrically connected to the patch antenna 111. The inner conductor 113 may also be electrically connected to the dipole 116. The dipole 116 may be electrically connected to the outer surface 115 of the linear conductive rod 114.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A passive parabolic antenna, comprising:

a parabolic reflector;

a subscriber module pocket approximately centered in the parabolic reflector;

a microwave feed assembly configured for placement adjacent the subscriber module pocket and configured to mate with a subscriber module antenna by forming a resonant cavity, the microwave feed assembly further comprising:

a patch antenna configured to form part of a resonant cavity;

a planar sheet of conductive material adjacent to the patch antenna;

a linear conductive rod connected at one end to the planar sheet of conductive material; and a dipole connected to an opposite end of the linear conductive rod; and an antenna cover configured to mate with the parabolic reflector and enclose the microwave feed assembly.

2. The passive parabolic antenna according to claim 1, further comprising an insert panel for receiving the microwave feed assembly and interfacing with the subscriber module pocket.

3. The passive parabolic antenna according to claim 1, wherein the parabolic reflector further comprises a plastic material having a metallic lining on an inner surface.

4. The passive parabolic antenna according to claim 1, wherein the metallic lining comprises plasma arc coated metal.

5. The passive parabolic antenna according to claim 1, wherein the metallic lining comprises adhesively secured metal foil.

6. The passive parabolic antenna according to claim 1, wherein the patch antenna is further configured for connection to an inner conductor within the linear conductive rod.

7. The passive parabolic antenna according to claim 6, wherein the inner conductor is further configured for connection to the dipole.

8. The passive parabolic antenna according to claim 1, wherein the subscriber module pocket is configured to receive a subscriber module radio antenna.

9. The passive parabolic antenna according to claim 8, wherein the subscriber module pocket is further configured to receive the subscriber module radio antenna in interference fit.

10. The passive parabolic antenna according to claim 9, wherein the subscriber module pocket further comprises indentations configured to provide ramps inside the subscriber module pocket to achieve the interference fit with the subscriber module radio antenna.

11. The passive parabolic antenna according to claim 8, wherein the subscriber module pocket is further configured to secure the subscriber module radio antenna using fasteners.

12. The passive parabolic antenna according to claim 6, wherein the subscriber module pocket is further configured to secure the subscriber module radio antenna using a detent mechanism.

13. The passive parabolic antenna according to claim 1, wherein the antenna cover comprises a dish having a flat portion.

14. The passive parabolic antenna according to claim 13, wherein the antenna cover further comprises a metallic subreflector on an inside surface of the flat portion.

15. A method of boosting signal strength of a conventional subscriber module radio antenna, comprising:

providing a passive parabolic antenna, comprising:

a parabolic reflector;

a subscriber module pocket approximately centered in the parabolic reflector;

a microwave feed assembly configured for placement adjacent to the subscriber module pocket, the microwave feed assembly further comprising:

a patch antenna configured to form part of a resonant cavity;

a planar sheet of conductive material adjacent to the patch antenna;

a linear conductive rod connected at one end to the planar sheet of conductive material; and a dipole connected to an opposite end of the linear conductive rod; and an antenna cover configured to mate with the parabolic reflector and enclose the microwave feed assembly; and sliding the subscriber module pocket over the top of a subscriber module radio antenna.

16. The method according to claim 15, wherein sliding the subscriber module pocket over the top of the conventional subscriber module radio antenna comprises an interference fit between the subscriber module pocket and the subscriber module radio antenna.

17. The method according to claim 15, further comprising applying an adhesive to the top of the subscriber module radio antenna, or an inside of the subscriber module pocket, or both, prior to sliding the subscriber module pocket over the top of the subscriber module radio antenna.

18. The method according to claim 15, further comprising adjusting the aim of the passive parabolic antenna toward a selected target to maximize signal gain.

19. The method according to claim 15, wherein providing the passive parabolic antenna further comprises providing an insert panel for receiving the microwave feed assembly and interfacing with the subscriber module pocket.

20. The method according to claim 15, wherein the parabolic antenna further comprises a plastic material having a metallic lining on an inner surface.

21. A wireless communications system, comprising:

a pair of wireless transceivers directed at each other, each wireless transceiver further comprising:

a subscriber module radio antenna configured for connection to a computer network; and a passive parabolic antenna in communication with the subscriber module radio antenna, wherein the passive parabolic antenna comprises:

a parabolic reflector;

a subscriber module pocket approximately centered in the parabolic reflector;

a microwave feed assembly configured for placement adjacent to the subscriber module pocket, the microwave feed assembly further comprising:

a patch antenna configured to form part of a resonant cavity;

a planar sheet of conductive material adjacent to the patch antenna;

a linear conductive rod connected at one end to the planar sheet of conductive material; and a dipole connected to an opposite end of the linear conductive rod; and an antenna cover configured to mate with the parabolic reflector and enclose the microwave feed assembly.

22. The wireless communications system according to claim 21, wherein the passive parabolic antenna further comprises an insert panel for receiving the microwave feed assembly and interfacing with the subscriber module pocket.

23. The wireless communications system according to claim 21, wherein the parabolic reflector further comprises a plastic material having a metallic lining on an inner surface.

24. The wireless communications system according to claim 21, wherein the subscriber module pocket is configured to receive a subscriber module radio antenna.

25. The wireless communications system according to claim 24, wherein the subscriber module pocket is further configured for interference fit with the subscriber module radio antenna.

* * * * *